US009456261B2

(12) United States Patent
Holm Jensen

(10) Patent No.: US 9,456,261 B2
(45) Date of Patent: Sep. 27, 2016

(54) RETRACTABLE MICROPHONE ASSEMBLY EMBEDDABLE IN DESKS

(71) Applicant: Albiral Display Solutions, S.L., Barcelona (ES)

(72) Inventor: Henrik Bo Aage Holm Jensen, Barcelona (ES)

(73) Assignee: Albiral Display Solutions, S.L., Barcelona (ES)

( * ) Notice: Subject to any disclaimer, the term of this patent is extended or adjusted under 35 U.S.C. 154(b) by 0 days.

(21) Appl. No.: 14/786,102

(22) PCT Filed: Apr. 16, 2014

(86) PCT No.: PCT/ES2014/070330
§ 371 (c)(1),
(2) Date: Oct. 21, 2015

(87) PCT Pub. No.: WO2014/174136
PCT Pub. Date: Oct. 30, 2014

(65) Prior Publication Data

US 2016/0080846 A1 Mar. 17, 2016

(30) Foreign Application Priority Data

Apr. 26, 2013 (ES) ..... 201330507

(51) Int. Cl.

| | |
|---|---|
| ***H04R 9/08*** | (2006.01) |
| ***H04R 1/02*** | (2006.01) |
| ***H04R 1/08*** | (2006.01) |
| ***H04R 1/04*** | (2006.01) |

(52) U.S. Cl.
CPC ..... *H04R 1/025* (2013.01); *H04R 1/028* (2013.01); *H04R 1/04* (2013.01); *H04R 1/08* (2013.01); *H04R 2201/029* (2013.01)

(58) Field of Classification Search
CPC ..... H04M 1/03; H04R 1/04; H04R 1/08; H04R 1/025; H04R 1/028; H04R 1/083; H04R 1/38; H04R 1/406; H04R 9/08; H04R 11/06; H04R 2201/029; H04R 2499/13
USPC ..... 381/361, 363, 365, 368
See application file for complete search history.

(56) References Cited

U.S. PATENT DOCUMENTS

| | | | | |
|---|---|---|---|---|
| 2,288,822 A * | 7/1942 | McCarron | ..... | H04R 1/08 381/366 |
| 2014/0169608 A1* | 6/2014 | Hallington | ..... | H04R 3/00 381/369 |

FOREIGN PATENT DOCUMENTS

| | | |
|---|---|---|
| GB | 653093 A | 5/1951 |
| GB | 2491636 A | 12/2012 |

OTHER PUBLICATIONS

Moronta, A. Martin, "International Search Report" for PCT/ES2014/070330, as mailed Jul. 2, 2014, 5 pages.

(Continued)

*Primary Examiner* — Brian Ensey
(74) *Attorney, Agent, or Firm* — Winstead PC

(57) ABSTRACT

A retractable microphone assembly embeddable in desks, comprising a housing, a frame provided with an opening and a cover for the opening, a microphone, a mobile structure for supporting the microphone, for moving the microphone between a lower hidden position and an upper position of use, means for actuating and guiding the mobile support structure, comprising a centering element for the microphone which can be moved between a position wherein the upper portion thereof is hidden below the frame and a position wherein it projects from the frame through the opening, said centering element being provided with lighting means, such that the functions of centering the microphone, applying pressure to the cover and visual indication of the operational status of the microphone can be carried out.

9 Claims, 6 Drawing Sheets

(56) References Cited

OTHER PUBLICATIONS

Goudy, Ginny; "Clockaudio to Launch New Retractable Mics for Conference Environment"; The Wire: A Virtual Press Conference from Sound & Video Contractor, http://blog.svconline.com/briefingroom/2009/05/29/clockaudio-to-launch-new-retractable-mics-for-conference-environment/; May 29, 2009; 5 pages.

Microfono Retractil Iluminado, Jan. 30, 2012, URL: https://www.youtube.com/watch?V=QPQLMDHM94.

* cited by examiner

STATE OF THE ART

RETRACTABLE MICROPHONE ASSEMBLY EMBEDDABLE IN DESKS

The present invention relates to a retractable microphone assembly embeddable in desks, which includes a large number of functions with a minimum number of components.

BACKGROUND OF THE INVENTION

Retractable microphone assemblies embeddable in desks which comprise a housing, a frame having an opening and an opening cover, a microphone, a movable microphone support structure for moving the microphone from a hidden lower position to an upper use position, and means for actuating and guiding the movable support structure, are known in the state of the art.

An example of this type of assemblies is that disclosed in GB-653093, the representative image of which is reproduced as FIG. 7 (obviously, the numbering does not correspond to that used herein).

Currently, it is common to use flex-type microphones which, on retracting it, if it remains folded, may strike, graze or scratch the embedding frame, thereby gradually wearing both the microphone and the frame.

Furthermore, as can be observed in the aforementioned document of the state of the art, an opening mechanism that opens a cover of the assembly before the microphone pushes it is usually provided, such that the microphone is not responsible for opening the cover.

Likewise, a light indicating speaking turn is usually envisaged in these types of microphones. This further increases the complexity of the assembly.

The objective of the present invention is to supply all these functions while guaranteeing its reliability, reducing the complexity of the assembly and simultaneously offering a pleasant aesthetic appearance.

DESCRIPTION OF THE INVENTION

In order to overcome the aforementioned shortcomings, the present invention proposes a retractable microphone assembly embeddable in desks, which comprises a housing, a frame having an opening and a cover for the opening, a microphone, a movable microphone support structure for moving the microphone between a hidden lower position and an upper use position, and means for actuating and guiding the movable support structure, which is characterised in that it comprises a centering element for the microphone, said centering element being movable between a position wherein the upper portion thereof is hidden beneath the frame and a position in which it projects from the frame through the opening, said centering element being equipped with lighting means, such as to enable the functions of centering the microphone, pushing the cover and visually indicating the operational status of the microphone.

According to various optional characteristics of the invention:

- the assembly comprises a return spring for returning the centering element to its position wherein its upper portion projects from the frame and retention means for retaining the centering element in the hidden position underneath the frame;
- the retention means comprise a tie solidarily connected to the centering element having a retention protrusion, wherein said retention element rests on the upper portion of the movable structure, such that when the latter rises, the centering element ascends solicited by the return spring;
- the actuation and guiding means of the movable support structure comprise pulleys and a belt;
- the opening, cover and portion that projects from the centering element are circular;
- the centering element comprises the portion destined for projecting, a central body and a tie;
- the assembly comprises a raising and lowering button and a request-to-speak button;
- the pulleys and the belt are smooth.

Lastly, the casing of the upper portion of the centering element is made of translucent material, wherein the light sources, preferably LEDs, are disposed in the interior thereof.

BRIEF DESCRIPTION OF THE DRAWINGS

In order to better understand the foregoing, drawings are attached which, schematically and solely by way of non-limiting example, represent preferred embodiments. The last figure shows a representation of the state of the art considered the closest prior art.

DESCRIPTION OF A PREFERRED EMBODIMENT

Figure 1:
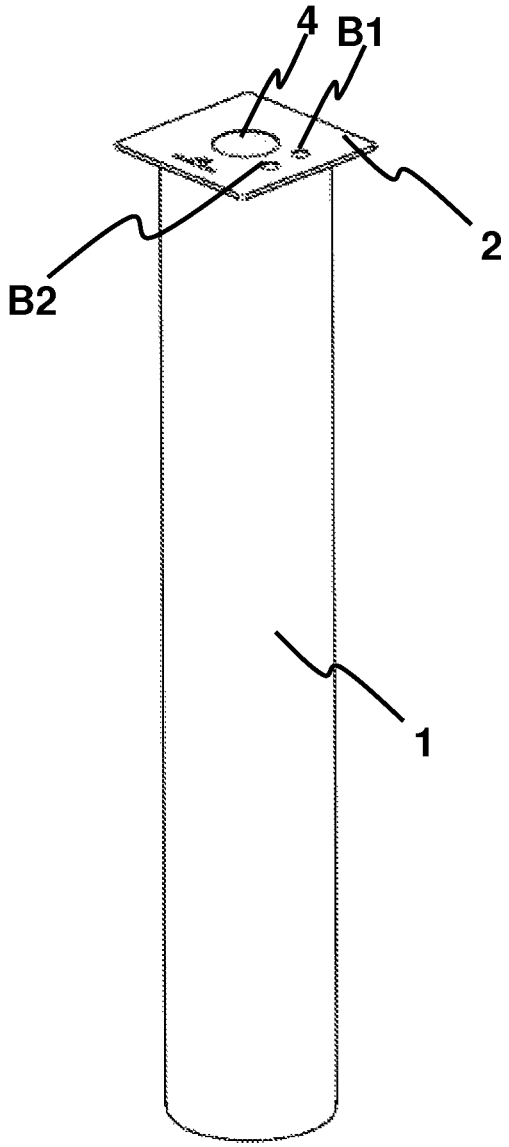
FIG. 1 shows a perspective view of the assembly according to the invention, assembled and ready for embedding in a desk.

As can be observed in FIGS. 1 to 7, the invention relates in general to a retractable microphone M assembly embeddable in desks, which comprises a housing 1, a frame 2 having an opening 3 and a cover 4 for the opening, a microphone M, a movable support structure E supporting the microphone M for moving the microphone M between a hidden lower position and an upper use position, and means A for actuating and guiding the movable support structure E.

Specifically, according to the present invention, the assembly comprises a centering element 5 for the microphone movable between a position wherein the upper portion 5A thereof is hidden beneath the frame 2 and a position wherein it projects from the frame 2 through the opening 3, said centering element 5 having lighting means, such that it can perform the functions of centering the microphone M, pushing the cover 4 and visually indicating the operational status of the microphone M.

Figure 3:
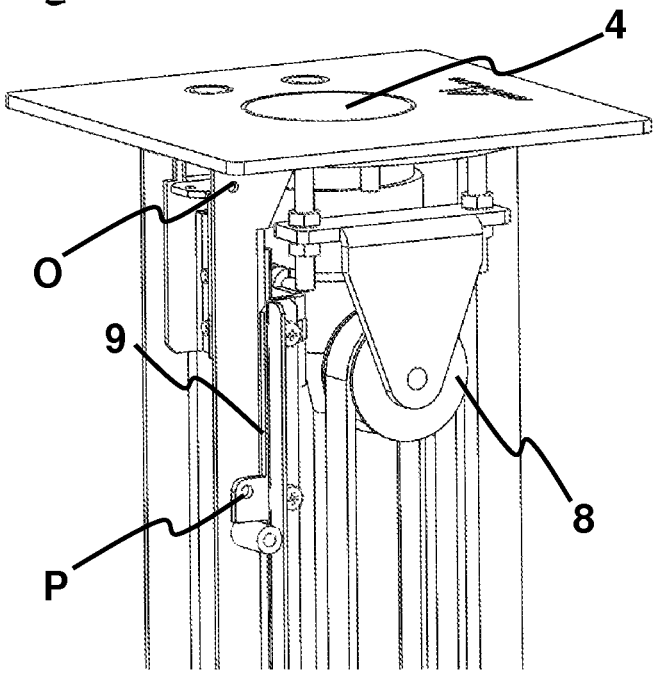
FIG. 3 shows a perspective view of the interior of the upper portion of the assembly.
Figure 4:
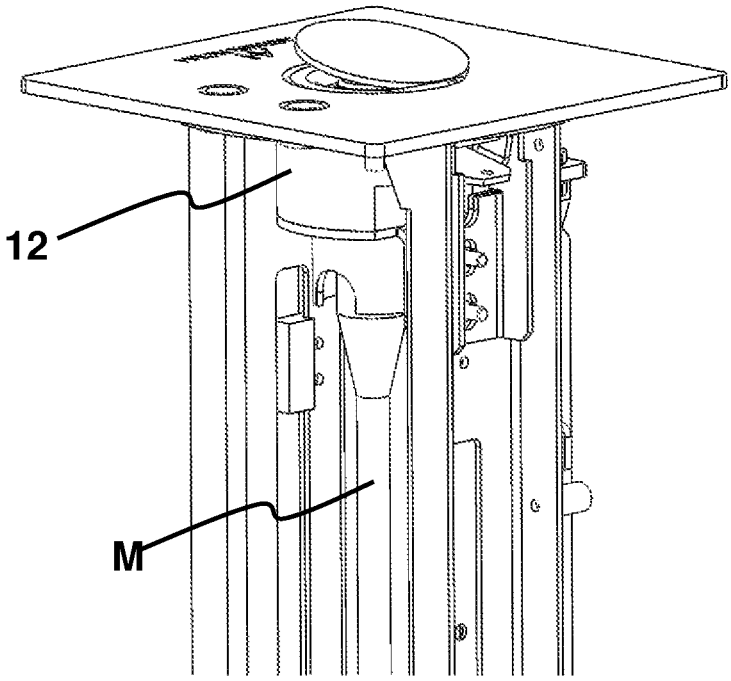
FIG. 4 shows a perspective view of the interior of the upper portion of the assembly when the cover has begun to open on being pushed by the centering element.
Figure 5:
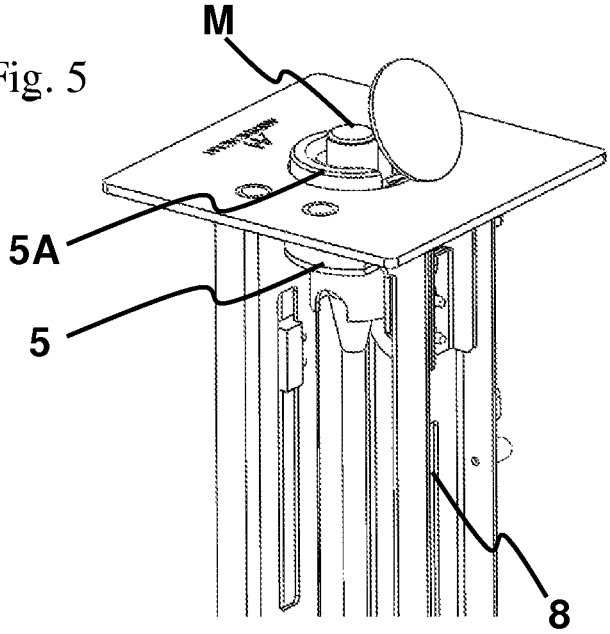
FIG. 5 shows a perspective view of the interior of the upper portion of the assembly when the cover is nearly or completely open.
Figure 6:
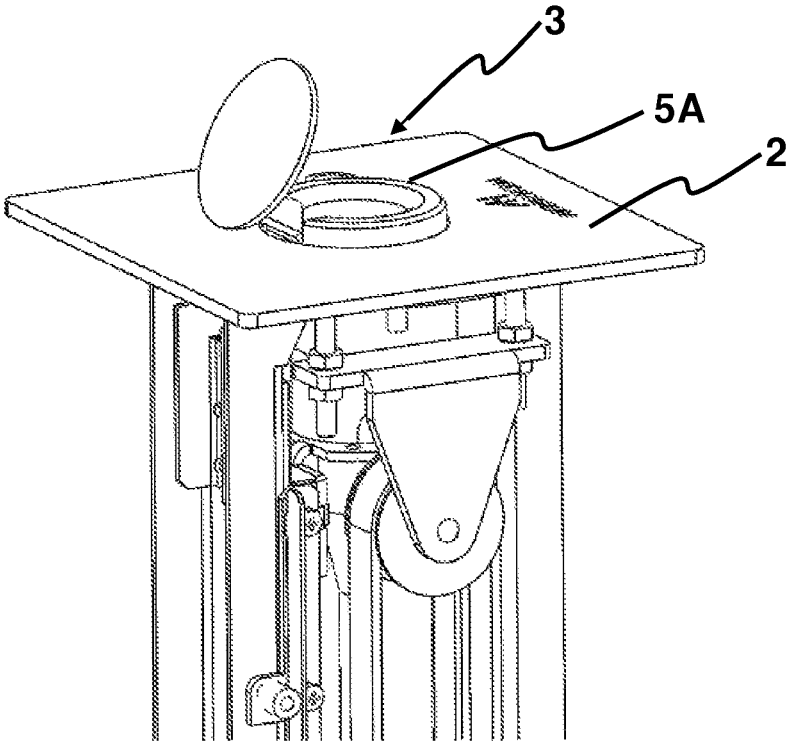
FIG. 6 shows a perspective view of the interior of the upper portion of the assembly wherein the projecting portion of the centering element can be more clearly seen.
Figure 7:
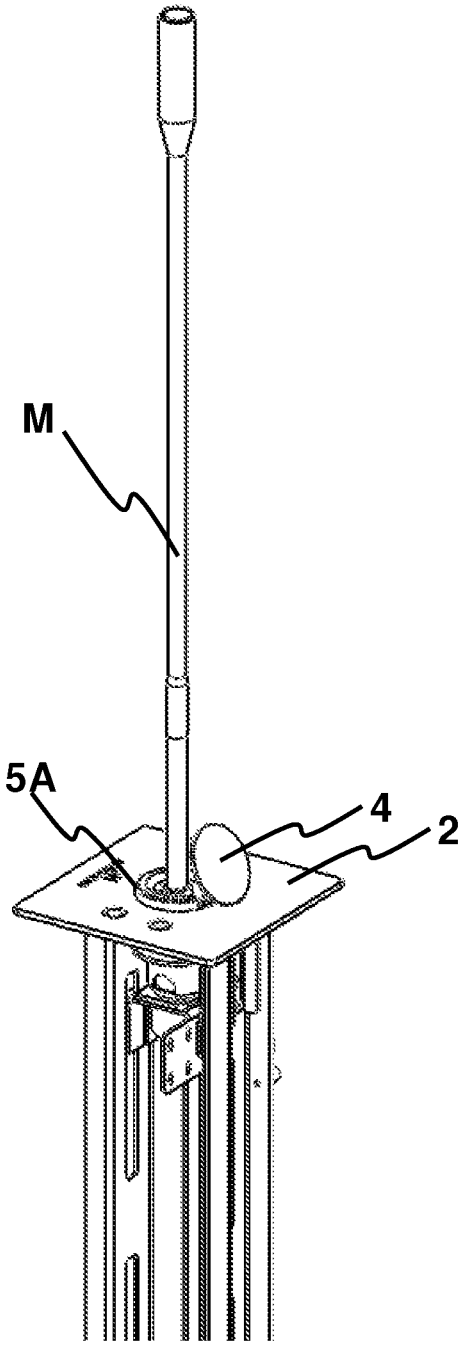
FIG. 7 shows the final assembly with the microphone disposed in the use position.
Figure 8:
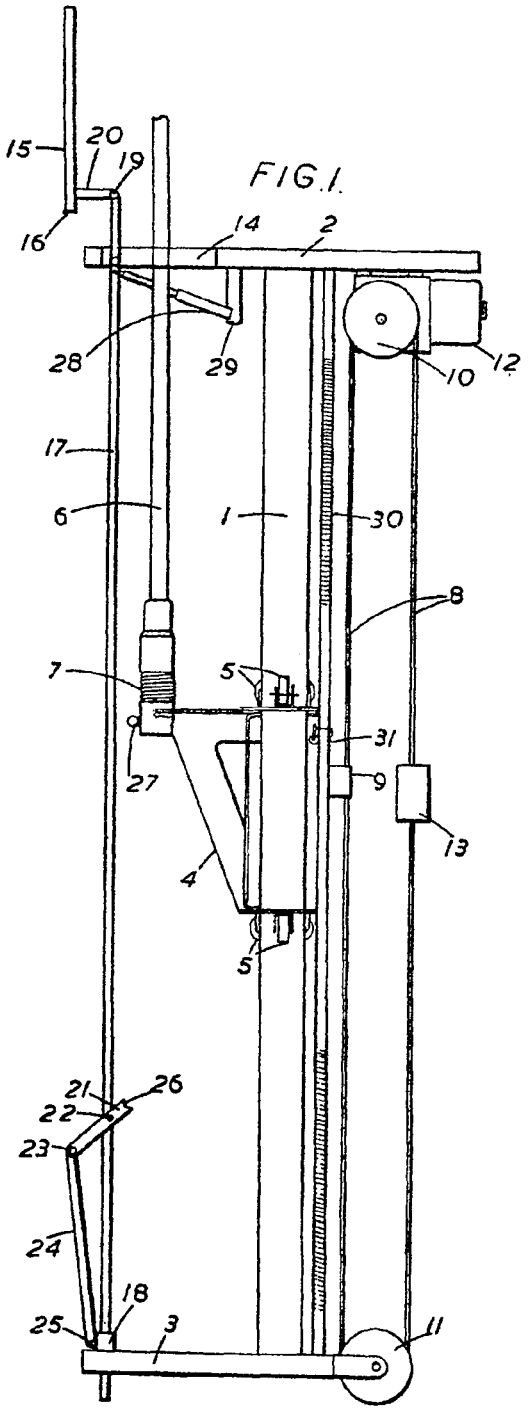
FIG. 8 shows a microphone and housing assembly of the state of the art.

According to a particularly preferred embodiment, illustrated in the figures, the assembly comprises a return spring (not shown) for returning the centering element 5 to its position wherein the upper portion thereof projects from the frame 2 and retention means for retaining the centering element 5 in the hidden position underneath the frame 2. As shown in FIG. 3, the flange 3 has an orifice for fixing the lower end of the spring, the other end of which would be fixed to the aforementioned orifice O, disposed near the cover. Disposed right underneath said flange is a cylindrical protrusion whose function is to physically stop the descent.

The retention means comprise a tie 9 solidarily connected to the centering element 5 and having a retention protrusion 10, wherein said retention protrusion exerts pressure on the lower portion of the movable structure E, such that, on rising, the centering element 5 ascends solicited by the return spring.

Figure 2:
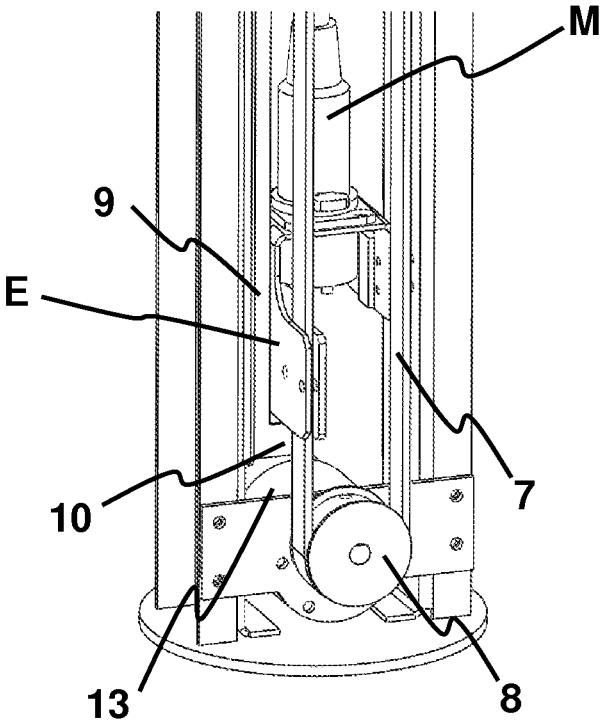
FIG. 2 shows a perspective view of the interior of the lower portion of the assembly.

The actuation and guiding means of the mobile support structure E comprise pulleys 8 and a belt 7, wherein the lower pulley is actuated by a motor 13, as can be observed in FIG. 2.

Preferably, the opening 3, the cover 4 and the projecting portion of the centering element 5 are circular. Obviously, other shapes can also be devised, although the circular shape is preferred due to being complementary to the cylindrical shape of most microphones.

The centering element 5 comprises the portion 5A intended for projecting, a central body 12 and the tie 9, all of which are solidarily connected therebetween. A raising and lowering button B1 and a request-to-speak button B2 are envisaged in the embedding frame.

Advantageously, the pulleys and belts are smooth and preferably made of plastic, whereupon the system functions properly with a certain belt tension but, in the event that the microphone becomes blocked, whether due to entrapment or external causes, the belt slips, whereby the blocking force is safe without causing damage.

The casing of the upper portion 5A of the centering element is made of translucent material with light sources, preferably LEDs, disposed in the interior thereof.

All the microphones have a flex part that the user adapts to orient the microphone towards him/herself. The system is closed inversely to its aperture, i.e. first the microphone is hidden and, in its final section, the centering element descends; next, the cover is closed. Since the frame centering element projects outwards, it protects the microphone and frame at all times during the descent, regardless of how the microphone flex has been adapted, since the centering element, which is made of plastic, protects it.

Despite the fact that reference has been made to a specific embodiment of the invention, it is evident for a person skilled in the art that the microphone assembly described is susceptible to many variations and changes, and that all of the aforementioned details may be substituted for other, technically equivalent ones without detracting from the scope of protection defined by the attached claims.

The invention claimed is:

1. A retractable microphone assembly embeddable in desks, which comprises a housing, a frame having an opening and a cover for the opening, a microphone, a movable support structure supporting the microphone, where said movable support structure is intended to move the microphone between a hidden lower position and an upper use position, and a mechanism for actuating and guiding the movable support structure, wherein the retractable microphone assembly comprises a centering element for the microphone, said centering element being movable between a position wherein the upper portion thereof is hidden beneath the frame and a position wherein it projects from the frame through the opening, said centering element having lighting elements to enable the functions of centering the microphone, pushing the cover and visually indicating the operational status of the microphone.

2. The assembly, according to claim 1, which comprises a return spring for returning the centering element to its position wherein the upper portion thereof projects from the frame) and a retention mechanism for retaining the centering element in the hidden position beneath the frame.

3. The assembly, according to claim 2, wherein the retention mechanism comprise a tie solidarily connected to the centering element and having a retention protrusion, wherein said retention protrusion rests on the upper portion of the movable structure, such that, when the latter rises, the centering element ascends solicited by the return spring.

4. The assembly, according to claim 1, wherein the mechanism for actuating and guiding the movable support structure comprise pulleys and a belt.

5. The assembly, according to claim 1, wherein the opening, the cover and the projecting portion of the centering element are circular.

6. The assembly, according to claim 1, wherein the centering element comprises the portion for projecting outwards, a central body and a tie.

7. The assembly, according to claim 1, which comprises a raising and lowering button and a request-to-speak button.

8. The assembly, according to claim 4, wherein the pulleys and the belt are smooth.

9. The assembly, according to claim 1, wherein the casing of the upper portion of the centering element is made of translucent material, wherein the light sources, preferably LEDs, are disposed in the interior thereof.

* * * * *